US006443719B1

(12) United States Patent
Fenocchi et al.

(10) Patent No.: US 6,443,719 B1
(45) Date of Patent: Sep. 3, 2002

(54) EASY-MANUFACTURE OLDHAM COUPLING

(75) Inventors: David M. Fenocchi; Thomas R. Barito, both of Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/789,202

(22) Filed: Feb. 20, 2001

(51) Int. Cl.[7] ..... F03C 2/00
(52) U.S. Cl. ..... 418/55.3; 464/102
(58) Field of Search ..... 418/55.3; 464/102

(56) References Cited

U.S. PATENT DOCUMENTS 5,320,506 A 6/1994 Fogt
5,395,220 A * 3/1995 Miura et al. ..... 418/55.3
5,582,512 A * 12/1996 Bush ..... 418/55.3
6,071,100 A * 6/2000 Yamada et al. ..... 418/55.3
6,254,755 B1 * 7/2001 Miura et al. ..... 418/55.3

FOREIGN PATENT DOCUMENTS

JP 09-032748 * 2/1997 ..... 418/55.3
JP 11-182459 * 7/1999 ..... 418/55.3
JP 11-324943 * 11/1999 ..... 418/55.3

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

An improved Oldham coupling ring is relatively easy to manufacture. Opposed circular arc portions are connected by angled portions to opposed flat portions. The circular arc portions are centered on a common center. As such, the invention is relatively easy to manufacture when compared to prior art systems.

6 Claims, 3 Drawing Sheets

EASY-MANUFACTURE OLDHAM COUPLING

BACKGROUND OF THE INVENTION

This invention relates to an Oldham coupling which is manufactured in a simplified manner.

Scroll compressors are becoming widely utilized in refrigerant compression applications. In a typical scroll compressor a first scroll member has a base and a generally spiral wrap extending from the base. The wrap of the first scroll member interfits with a spiral wrap of a second scroll member, and the scroll member is driven to orbit relative to the first scroll member to compress an entrapped refrigerant. The orbiting movement is achieved from a rotary motor which is connected to the second scroll member through a non-rotation coupling. Typically, an Oldham coupling is provided. The Oldham coupling includes keys which slide in slot structures on the second scroll member, and which in turn has keys extending into slots in a crankcase which supports the second scroll member. In some Oldham couplings, the first scroll member receives the keys rather than the crankcase. The Oldham coupling can move in the slots in the crankcase along a linear path. This allows rotation of the drive motor to be translated into orbiting movement of the second scroll member.

The Oldham coupling is a relatively simple part, but it must meet several design criteria. In particular, the Oldham coupling must have an interior bore which will allow it to slide as described above while remaining out of contact with several components of the compressor which are positioned radially inwardly of the bore's inner periphery. Moreover, the Oldham coupling ring must have sufficient wall thickness throughout its entire periphery such that the part will be sufficiently robust for reliable use. Finally, the inner periphery of the Oldham coupling ring cannot be so complex that it is difficult or unduly expensive to manufacture.

SUMMARY OF THE INVENTION

In the disclosed embodiment of this invention, an Oldham coupling ring has a generally cylindrical inner periphery. Two opposed circular arcs are centered on a common axis, and are associated with the portions of the Oldham coupling which are received in keyways in the crankcase. The circular portions have a pair of angled portions at each of their circumferential extremes. The angled portions merge into flat portions which are positioned radially inwardly of the slots on the ring which receive keys from the orbiting scroll member. The inventive Oldham coupling ring is a relatively simple part to manufacture, in that its inner periphery is formed to be generally circular, with the angled portions on the flat portions being relatively simple portions to manufacture.

In another embodiment, there are three of the angled portions at each of the circumferential extends. This adds additional size to the ring at the area where the angled portions are merging into the flat portions.

These and other features of the present invention can be best understood from the following specification and drawings, the following of which is a brief description.

DETAILED DESCRIPTION OF A PREFERRED EMBODIMENT

Figure 1:
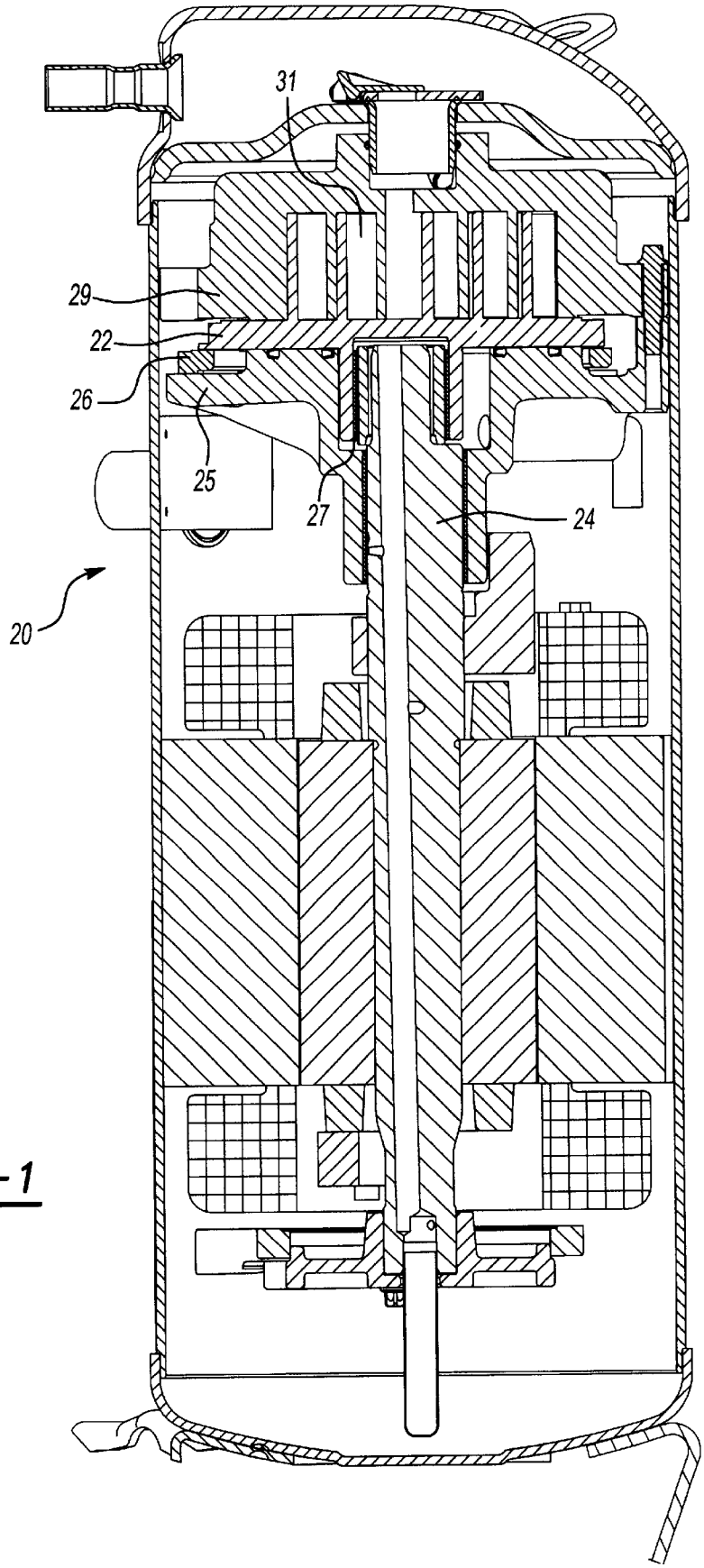
FIG. 1 is a cross-sectional view through a scroll compressor incorporating this invention.

A scroll compressor 20 is shown in FIG. 1 having an orbiting scroll 22 being driven by a shaft 24. An Oldham coupling 26 is positioned intermediate a crankcase 25 and the orbiting scroll 22. As is known, the shaft 24 drives the orbiting scroll 22 through a slider block connection 27. The Oldham coupling prevents the orbiting scroll 24 from rotating, and instead transmits the rotation from the shaft 24 into constrained orbiting movement of the orbiting scroll 22. As is also known, when the orbiting scroll 22 orbits, it orbits relative to a non-orbiting scroll 29. This orbiting movement compresses a refrigerant trapped in compression chambers 31.

Figure 2:
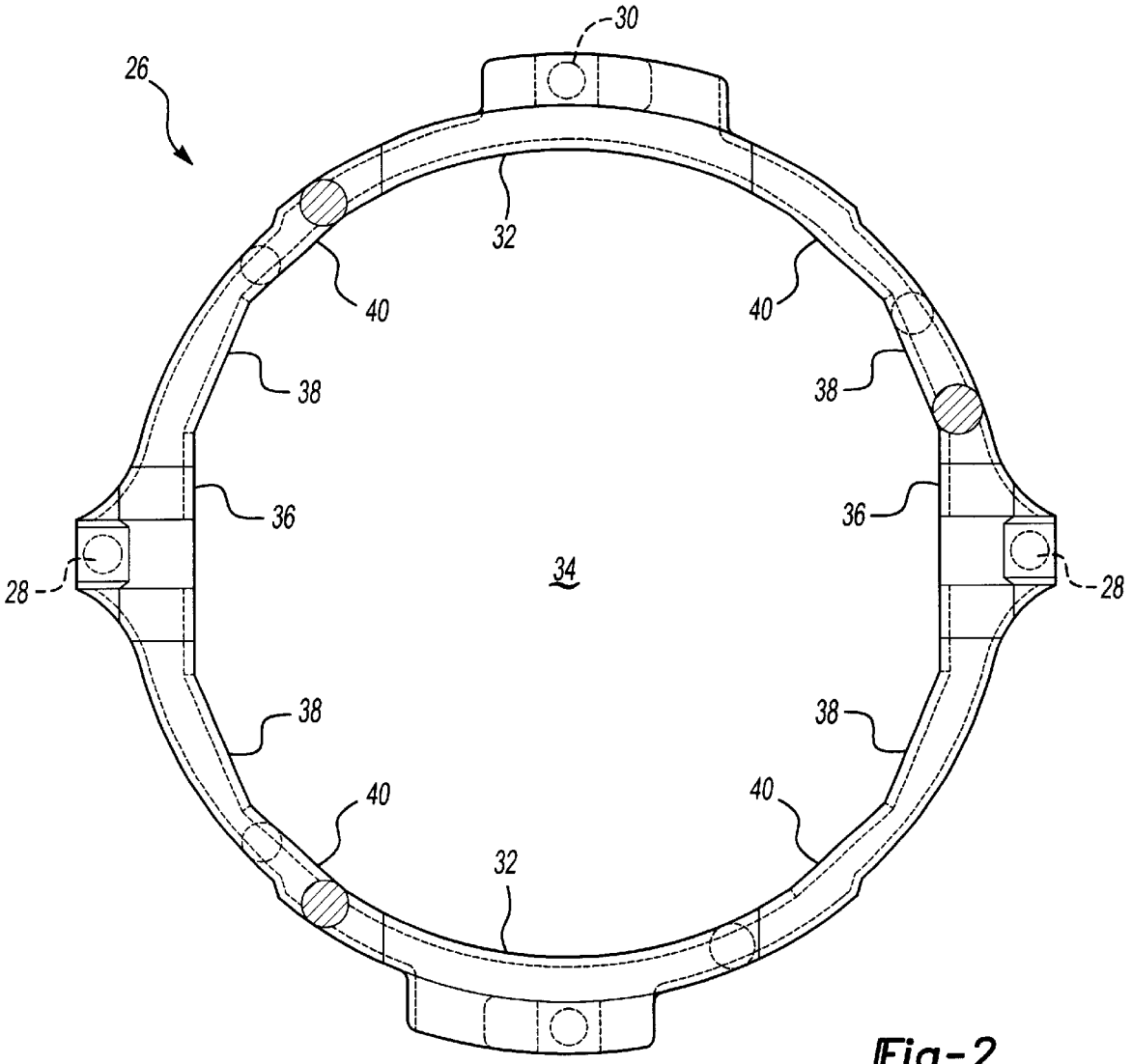
FIG. 2 is a plan view of an Oldham coupling according to the present invention.
Figure 3:
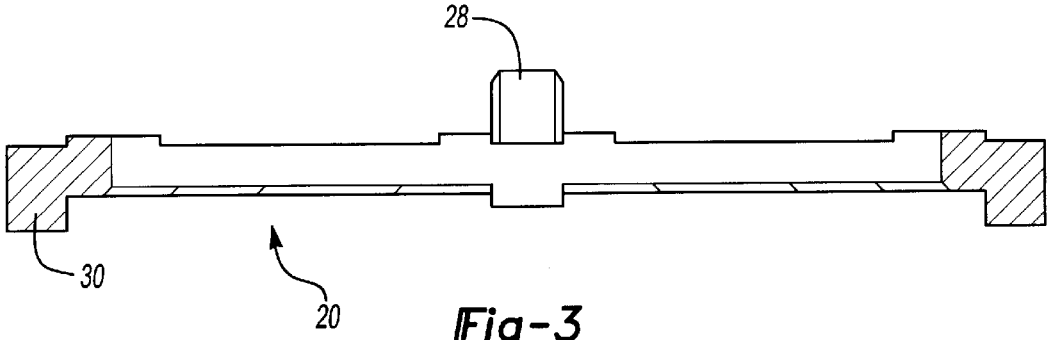
FIG. 3 is another sectional view.

As shown in FIGS. 2 and 3, the Oldham coupling ring 26 functions generally as known in the art. Keyways from orbiting scroll 22 receive keys 28. Keys 30 are formed at diametrically opposed positions which are spaced generally by 90° from the keys 28. The keys 30 fit into slots in the crankcase 25. As is known, during movement, the Oldham coupling ring 26 will slide vertically upwardly and downwardly in the direction illustrated in FIG. 2, and within the slots of crankcase 25. This is as known in the art. During this movement, the keys 28 are guided into keyways on orbiting scroll 22, preventing the orbiting scroll 22 from rotating, and instead constrain the orbiting scroll 22 to orbit.

As can be appreciated, as the Oldham coupling 26 moves, it must avoid portions of the crankcase 25 inwardly of its bore, along with any other internal structure. Thus, it is desirable to provide sufficient clearance within the inner periphery of the ring 26 to avoid contact with any such component. The present invention provides sufficient clearance, while still maintaining an easy to manufacture configuration. As shown, opposed circular arcs 32 are positioned radially inwardly of the keys 30. The arcs 32 are each centered on a common center 34. Flat portions 36 are positioned radially inwardly of the keys 28. Angled portions 38 and 40 connect each flat 36 to one circumferential end of an arc 32. The ring 26 provides sufficient clearance space, while still providing a relatively easy to manufacture configuration. The prior art had more complex configurations, and this invention is thus an improvement. Moreover, the prior art had configurations that would often result in undesirably thin wall sections that resulted in the ring not being sufficiently robust.

Figure 4:
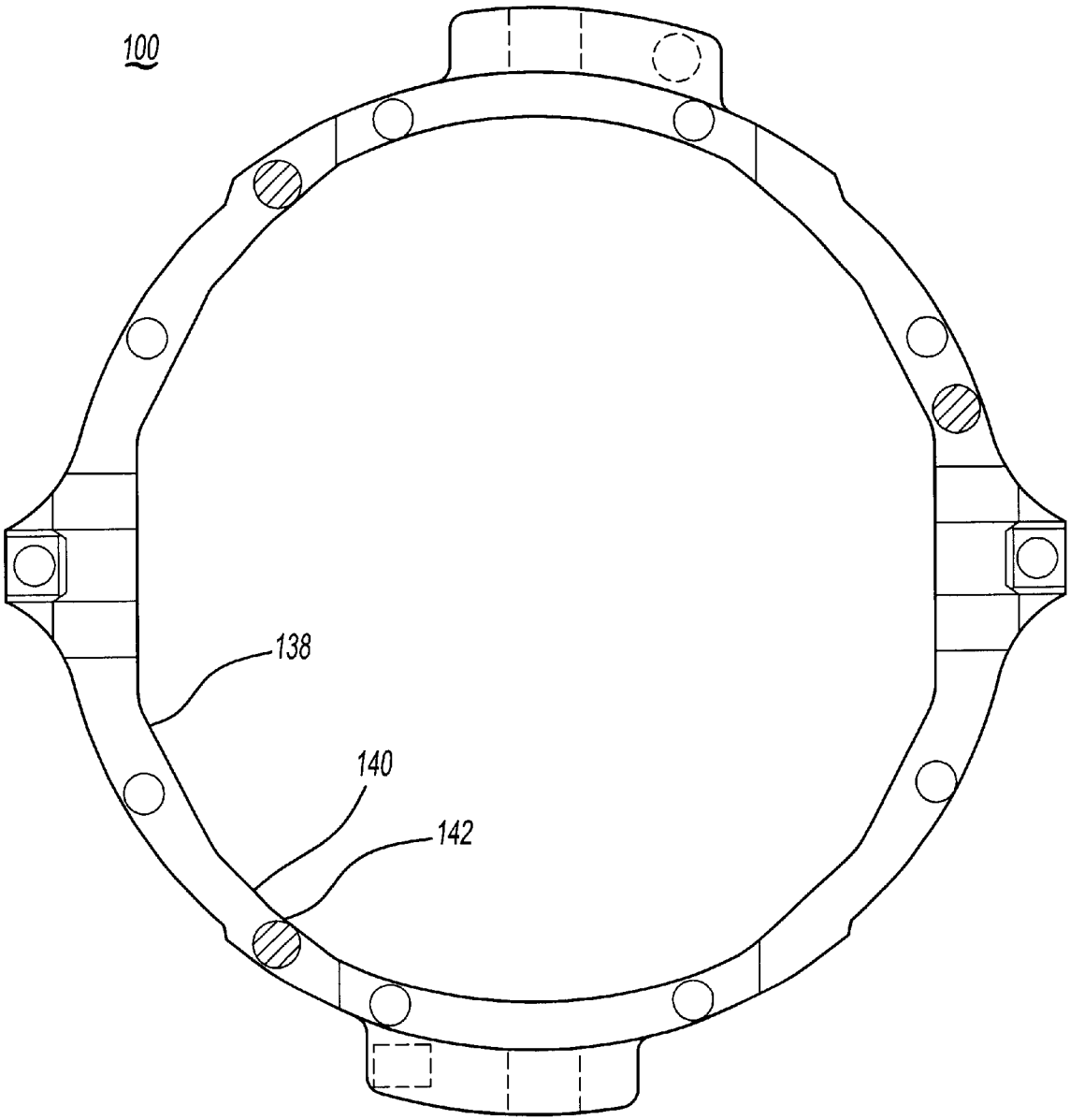
FIG. 4 shows another embodiment.

FIG. 4 shows another preferred embodiment of the ring 100. In ring 100, there are three angled portions 138, 140 and 142. This provides additional wall size in the area immediately adjacent to the point where the angled portions merge into the flat portion 36.

A preferred embodiment of this invention has been disclosed, however, a worker in this art would recognize that certain modifications would come within the scope of this invention. For that reason the following claims should be studied to determine the true scope and content.

What is claimed is:

1. A scroll compressor comprising:

a first scroll member having a base and a generally spiral wrap extending from said base;

a second scroll member having a base and a generally spiral wrap extending from said base, said wraps of said first and second scroll member interfitting to define compression chambers;

a shaft driven to rotate, said shaft being operatively connected to drive said second scroll member, a crankcase for supporting said second scroll member; and an Oldham coupling ring positioned between a guiding structure and said second scroll member, said Oldham coupling ring having diametrically opposed circular portions centered on a common point, and having flat portions spaced by 90° from said circular portions, said flat portions being connected to circumferential ends of said circular portion by angled portions, said angled portions being line segments which are not parallel to said flat portion, and said Oldham coupling ring being operatively connected to both said guiding structure and said second scroll member to cause said second scroll member to orbit when said shaft rotates.

2. A scroll compressor as recited in claim 1, wherein said guiding structure is on said crankcase.

3. A scroll compressor as recited in claim 2, wherein said circular arcs are positioned radially inwardly of structure to be received on said crankcase, and said flat portions are positioned radially inwardly of structure associated with said second scroll member.

4. A scroll compressor as recited in claim 3, wherein keys are formed on said ring and extend into slots in said crankcase, and said ring further including keys extending into slots from said second scroll member.

5. A scroll compressor as recited in claim 1, wherein there are at least two of said angled portions.

6. A scroll compressor as recited in claim 5, wherein there are three of said angled portions.

* * * * *